US005099747A

United States Patent [19]

Smith

[11] Patent Number: 5,099,747

[45] Date of Patent: Mar. 31, 1992

[54] MINEFIELD BREACHING SYSTEM

[75] Inventor: John L. C. Smith, Aldershot, England

[73] Assignee: Pains-Wessex Limited, England

[21] Appl. No.: 621,034

[22] Filed: Nov. 30, 1990

[30] Foreign Application Priority Data

Dec. 4, 1989 [GB] United Kingdom ..... 8927349

[51] Int. Cl.[5] ..... F41H 11/14

[52] U.S. Cl. ..... 89/1.13; 42/105; 89/1.34; 102/504

[58] Field of Search ..... 89/1.13, 1.34, 1.819, 89/1.818; 102/504; 42/105

[56] References Cited

U.S. PATENT DOCUMENTS

| | | | |
|---|---|---|---|
| 932,270 | 8/1909 | Goodwin | 89/1.34 |
| 2,069,276 | 2/1937 | Ryan | 102/504 |
| 2,876,702 | 3/1959 | Wheelwright et al. | 89/1.34 |
| 3,575,083 | 4/1971 | Hudick et al. | 89/1.34 |
| 3,620,162 | 11/1971 | King | 42/105 |
| 4,505,179 | 3/1985 | Nelson et al. | 102/504 |
| 4,683,797 | 8/1987 | Wittbrodt | 89/1.13 |
| 4,724,768 | 2/1988 | Robinson et al. | 102/504 |
| 4,799,906 | 1/1989 | Perkins | 89/1.34 |

FOREIGN PATENT DOCUMENTS 2200081A 7/1988 United Kingdom .

*Primary Examiner*—David H. Brown
*Attorney, Agent, or Firm*—Kinney & Lange

[57] ABSTRACT

A minefield breaching system or apparatus and a delivery projectile therefor comprises a projectile arranged to be mounted on a rifle, light mortar or similar weapon and to be projected in a desired direction by firing a round from the weapon into the projectile; an explosive line connected directly or indirectly at one end thereof to the projectile; and detonation means arranged to be connected directly or indirectly to the explosive line at the other end thereof for detonation of the explosive line; the projectile comprising a rocket the motor of which is arranged for operational ignition upon a round from the weapon being fired into the projectile, and the projectile carrying a presence or location indicator together with power means for operation of the indicator.

9 Claims, 2 Drawing Sheets

MINEFIELD BREACHING SYSTEM

FIELD OF THE INVENTION

This invention relates to a system or apparatus for use in breaching a minefield by which is meant for use in clearing a path of limited but usable width through a mine field for use, for example, by a company of infantry soldiers on foot.

DESCRIPTION OF PRIOR ART

It has been proposed that a system or apparatus for this purpose comprises a projectile arranged to be mounted on a rifle or light mortar or similar weapon arranged to be projected in a desired direction over the ground by firing a round from the weapon into the projectile whereby the energy of the round is transferred to propel the projectile over the ground. The projectile is arranged to be connected to an explosive line which is thereby intended in use to be carried across a suspected mine field in the desired direction whereafter the explosive line is detonated as it lies across the minefield to clear a pathway thereacross.

It will be understood that such an explosive line may be of the type comprising a outer casing filled with a continuous length of explosives at sufficient concentration upon detonation to blast the required path width in use. The casing may be of woven material or of plastic, which may be an extrudate, for example.

In practice, whilst such an arrangement is of potentially significant usefulness, and can readily be handled, in terms of its weight and bulk, as part of the regular equipment of an infantry soldier, it does suffer from the serious disadvantage that the range of travel of the projectile, when delivering, or to be more precise when towing a substantial weight of explosive line, has a range too limited to be of optimum value to infantry soldiery.

Additionally, a significant factor which does require consideration in the use of such a system is that a high percentage of infantry movements, and therefore the need to clear minefields, occurs at night, where the direction, and the continuing monitoring of the direction, of projection of the projectile and the explosive line can be difficult to judge, leading to serious practical deficiencies in providing safe correctly aligned paths through a minefield.

SUMMARY OF THE INVENTION

It is an object of the present invention to enable the provision of a delivery or towing apparatus for a line clearance system or apparatus which can overcome or at least substantially reduce these difficulties and problems.

According to one aspect of the present invention, there is provided a minefield breaching system or apparatus comprising a projectile arranged to be mounted on a rifle, light mortar or similar weapon and to be projected in a desired direction by firing a round from the weapon into the projectile; an explosive line connected directly or indirectly at one end thereof to the projectile; and detonation means arranged to be connected directly or indirectly to the explosive line at the other end thereof for detonation of the explosive line; the projectile comprising a rocket the motor of which is arranged for operational ignition upon a round from the weapon being fired into the projectile, and the projectile carrying a presence or location indicator together with power means for operation of the indicator. The invention includes within its scope a delivery projectile for use in a minefield breaching system or aparatus as herein defined.

By means of the invention a minefield clearance system is provided in which substantial range capability for the system is ensured by using a rocket propelled delivery projectile, whilst at the same time the presence or location indicator ensure that the position of the projectile upon landing is known and remains known to the operator of the system.

The indicator power means may be electrical power means.

The presence or location indicator may comprises a sound producing device and/or a luminous device which may be a flashing lamp, carried by the projectile.

Rocket propelled, round initiated, projectiles for use with light mortars or rifles or similar weapons are known for delivering an explosive pay load over many meters. In the present invention no explosive pay load need be carried by the rocket projectile. Instead the nose cone, for example, of the projectile, can be formed of a translucent or transparent material within which may be located a lamp or similar luminous device.

Such rocket propelled explosive delivering projectiles are usually provided with fins arranged to spin the projectile for added stability during travel over many meters to aid accuracy of delivery. With the use of a rocket propelled projectile in accordance with the present invention, such fins would usually not be employed, since any rotation of the projectile would twist the explosive line being towed, leading to potential tangling of the line.

DESCRIPTION OF THE DRAWINGS

In order that the invention may be more readily understood one embodiment thereof will now be described by way of example with reference to the accompanying drawings in which.

DETAILED DESCRIPTION OF THE PREFERRED EMBODIMENT

Figure 1:
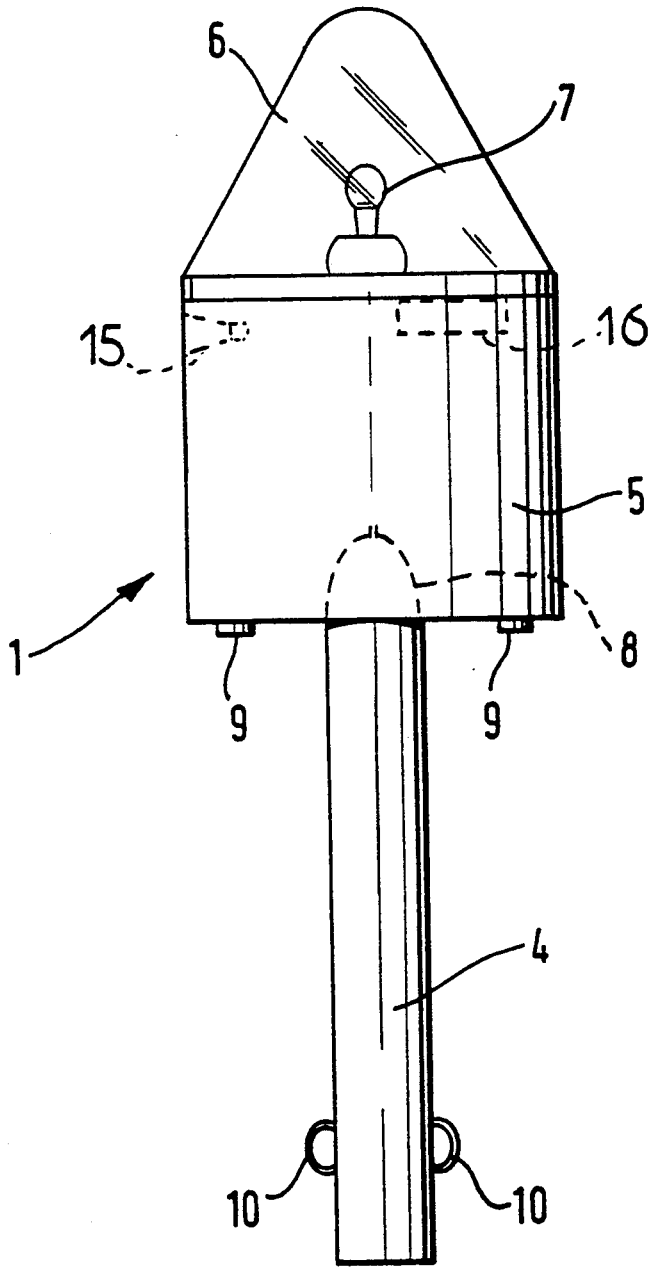
FIG. 1 is a schematic elevation of a rocket propelled projectile for use with a minefield clearance system in accordance with the invention.

Referring to the drawings it will be seen that there is provided a rocket projectile 1 for fitting, in this instance, over the muzzle 2 of an infantry soldiers rifle 3 by means of a tail tube 4 of the rocket. The main body 5 of the rocket 1 can readily be of a smaller configuration than normally used with free flying, explosive loaded projectiles, such as a grenade type projectile, since the required optimum range is considerably less than that which would be required with such a grenade type projectile. In place of the usual explosive charge in the nose of the projectile, it is to be seen that clear plastic nose cone 6 is provided within which is located a flashing light unit 7. In an alternative, not shown, Trilux gas disposed in a sealed tough glass tube may be used as the luminous means within the nose cone. Again alternatively or in addition a sound signal source 15 may be located within the projectile. The rocket propelled projectile carries with in it a "bullet trap" 8 whereat a round from the rifle 3 on which the projectile is mounted impacts into the rocket motor on firing the rifle and causes ignition of the projectile rocket motor. The projectile will also incorporate a power source 16, which may be an electrical battery, for the indicating arrangement, and additionally, in the example illustrated there is provided a rotating on/off switch (not shown) for the flashing light unit. In the usual way the rocket propelled projectile is provided with exhaust outlets 9 for use on ignition of the rocket, although the usually fitted fins, normally adjacent the tube 4 which would spin the projectile to provide balance and thereby greater accuracy and range, are omitted so as to avoid entangling the explosive line to be towed by the projectile.

It is to be observed that metal loops 10 are attached to the tail tube 4 of the projectile by means of which a bridle set of lines 11 can connect to an explosive line 12, appropriately coiled in a container 13 prior to use.

Figure 2:
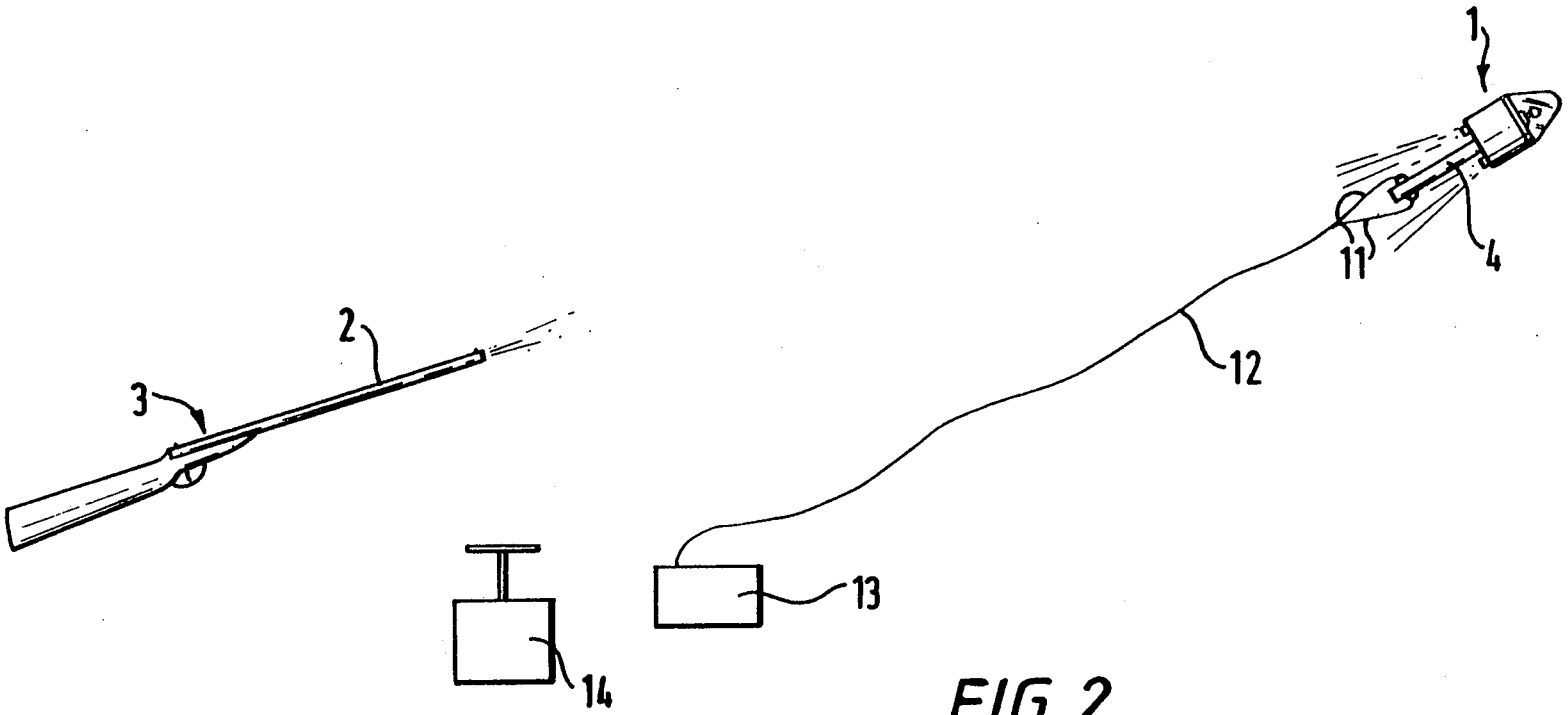
FIG. 2 is a schematic representation of the operation of a minefield clearance system using the projectile of FIG. 1.

In operation, as can be seen in FIG. 2, the projectile 1 illustrated is mounted on the rifle muzzle 2 of the infantry soldiers rifle 3 and is then initiated by a round being fired from the rifle into the bullet trap 8 whereupon the rocket motor is ignited and the rocket propelled projectile dispatched, towing the explosive line 12 behind it.

On falling to the ground and initiation of the flashing light unit 7 by automatic switch means, the position of the projectile is readily apparent both during the day, and in particular at night so that the operator, before initiating the detonation of the explosive line can check the correctness of the direction of the line, and can by appropriate pulling on the line straighten it so as to lead substantially in a straight line to the landed projectile to provide a straight path through the minefield (of great importance in operations during the night), and then safely initiate the detonation, by means of detonator 14, of the explosive line to clear the required path.

It is understood that the foregoing is merely exemplary of mine clearance systems and projectiles for delivery thereof in accordance with the invention and that modifications can readily be made thereto without departing from the true scope of the invention.

I claim:

1. A delivery projectile for a minefield breaching system of the kind including a projectile which includes means for mounting the projectile on a firing end of a rifle, light mortar or similar weapon and to be projected in a desired direction by firing a round from the weapon into the projectile, and an explosive line connected directly or indirectly at one end thereof to the projectile, and detonation means arranged to be connected directly or indirectly to the explosive line at the other end thereof for detonation of the explosive line, wherein the projectile comprises a rocket motor which is positioned to be impacted by a round from the weapon being fired into the projectile, which impact causes ignition of the rocket motor, and the projectile carries a location indicator, together with power means for operation of the indicator.

2. A delivery projectile as claimed in claim 1 wherein the projectile power means is electrical power means.

3. A delivery projectile as claimed in claim 1 wherein the location indicator comprises a sound producing device.

4. A delivery projectile as claimed in claim 1 wherein the rear external surface of the projectile is provided with metal loops attached thereto by means of which the projectile may be connected via a bridle set of lines to the explosive line.

5. A delivery projectile as claimed in claim 1 wherein the projectile is so configured without fins as to inhibit it from spinning during its travel through the air.

6. A delivery projectile for a minefield breaching system of the kind including a projectile which includes means for mounting the projectile on a firing end of a rifle, light mortar or similar weapon and to be projected in a desired direction by firing a round from the weapon into the projectile, and an explosive line connected directly or indirectly at one end thereof to the projectile, and detonation means arranged to be connected directly or indirectly to the explosive line at the other end thereof for detonation of the explosive line, wherein the projectile comprises a rocket motor which is positioned to be impacted by a round from the weapon being fired into the projectile, which impact causes ignition of the rocket motor, and the projectile carries a location indicator in the form of a luminous device, together with power means for operation of the device.

7. A delivery projectile as claimed in claim 6 wherein the luminious device is a lamp having a flashing mode of operation.

8. A delivery projectile as claimed in clain 6 wherein the nose cone of the projectile is provided with a casing portion of light transmitting material within which is located the luminous device.

9. A minefield breaching system or apparatus comprising a projectile having an opening which permits the projectile to be mounted on a firing end of a rifle, light mortar or similar weapon and to be projected in a desired direction by firing a round from the weapon into the opening of the projectile; an explosive line connected directly or indirectly at one end thereof to the projectile; and detonation means arranged to be connected directly or indirectly to the explosive line at the other end thereof for detonation of the explosive line; the projectile comprising a rocket motor positioned to be impacted by a round from the weapon being fired into the opening of the projectile, which impact causes ignition of the rocket motor, and the projectile carrying a location indicator together with power means for operation of the indicator.

* * * * *